US005599406A

United States Patent [19]

Prasad et al.

[11] Patent Number: 5,599,406

[45] Date of Patent: Feb. 4, 1997

[54] GOLD-COLORED COPPER-ALUMINUM-INDIUM ALLOY

[75] Inventors: Arun Prasad, Cheshire, Conn.; Michael Weston, Danville, N.Y.; Grant Bauer, Point Pleasant, N.J.

[73] Assignee: Gemetals Corporation, Danville, N.H.

[21] Appl. No.: 455

[22] Filed: Jan. 4, 1993

[51] Int. Cl.[6] ..... C22C 9/00; C22C 9/01

[52] U.S. Cl. ..... 148/436; 420/489

[58] Field of Search ..... 148/436; 420/489

[56] References Cited

U.S. PATENT DOCUMENTS 1,960,740 5/1934 Gray et al. .
3,998,633 12/1976 Rhodes ..... 420/489

FOREIGN PATENT DOCUMENTS 57-70244 4/1982 Japan ..... 420/489
60-177148 9/1985 Japan ..... 420/489

OTHER PUBLICATIONS

Stirling, P. H., The Copper Rich Alloys of the System Copper–Aluminum–Indium, Journal of the Institute of Metals, vol. 84, 1955.

*Primary Examiner*—Deborah Yee
*Attorney, Agent, or Firm*—Morse, Altman & Benson

[57] ABSTRACT

A copper-aluminum-indium alloy approaches gold in spectral appearance, tarnish resistance and mechanical durability, by virtue of a specific formulation and microstructure. The formulation consists of the following essential ingredients by total weight, in a copper matrix: from 7 to 12% of aluminum, from 5 to 11% of indium, and no more than 3% of a essentially non-ferromagnetic remainder. The required microstructure is in the form an essentially ternary alloy having a quenched single phase, an average grain size of no more than 100 μm in diameter. Preferably, the above specified 3% remainder includes: a modifier selected from the class consisting of boron, silicon, lithium, magnesium, zinc and phosphorous; a strengthener selected from the class consisting of silver, gold, palladium, platinum, iridium, ruthenium and rhodium; and a system stabilizer, preferably selected from the class consisting of yttrium, cerium, lanthanum, hafnium, zirconium, chromium, titanium, nickel, iron and manganese.

4 Claims, 2 Drawing Sheets

GOLD-COLORED COPPER-ALUMINUM-INDIUM ALLOY

BACKGROUND OF THE INVENTION

1. Field of the Invention

The present invention relates to alloys of gold color and, more particularly, to alloys that simulate gold in spectral appearance, tarnish resistance and mechanical properties, and that are used in such products as coinage, giftware, kitchenware, and other elegant metal objects.

2. The Prior Art

From very earliest times, gold has been a metal of special interest because of its extraordinary spectral, chemical and mechanical characteristics, i.e. its specular reflectance, tarnish resistance and ductile behavior.

Although ancient royalty often employed gold-based tableware and vessels, for the past four or five centuries the more usual high quality implements have been based on sterling silver. Typically this metal consists of about 92.5% silver and balance of copper, which eliminates gassiness that occurs when pure silver solidifies. Inexpensive flatware, dishes, bowls, etc., have been based on the use of nickel silver, a family of Cu-Ni-Zn alloys, which after finishing have been plated with pure silver. The base alloy in this case has a yellowish color, which although whiter than brass, is noticeable immediately when the plating is worn away.

One reason why silver has never become a competitor of gold in some fields is that tarnishing of silver alloy or plated silver articles results from contact with sulfurous atmosphere and is objectionable because of the hand-polishing usually required to maintain brightness. Metallurgists and artisans have tried for centuries to improve the tarnish resistance of such silver articles by judicious alloying, but without success. Efforts to reduce annoying tarnishing in such articles also have involved depositing, on silver surfaces, other metals having greater nobility than silver, including gold, platinum, palladium and rhodium, all of which are unduly expensive when so used.

Also low cost flatware has been fabricated from stainless steel. But, although stainless steel has good tarnish resistance, its appearance is that of a base metal.

The appearance of untarnished gold remains a very desirable objective for the fabrication of low cost jewelry, tableware, giftware, etc.

Copper alloys are of particular interest in the simulation of gold because of the inherent reddish color of elemental copper. Copper alloys have included: brasses, which generally differentiate from gold because of their bright yellow appearance; and bronzes which generally differentiate from gold because of their dull brown appearance. Furthermore, attempts to modify the optical properties of these brasses and bronzes often have been accompanied by unacceptable changes in their tarnish resistance.

A variety of copper alloys have been studied for their general interest, as well as for their relevance to gold simulation. A general study of one such alloy, P. H. Stirling, B.Sc., Ph.D., A.R.I.C., Junior Member., and Professor G. V. Raynor, M.A. D.Sc., Vice President (both of the University of Birmingham), entitled, "The Copper-Rich Alloys Of The System Copper-Aluminum-Indium," was reported in the Journal Of The Institute Of Metals, 1955–56, Vol. 84. This article discussed the metallurgy of Cu-Al-In alloys in detail, but did not address any specific metallurgical relationships that were intended to provide a marked similarity to gold in specular reflectance, tarnish resistance and ductile behavior.

BRIEF DESCRIPTION OF THE PRESENT INVENTION

The primary object of the present invention is the identification of an alloy for the production of quality metal objects including jewelry, giftware, flatware, holloware and the like, having the unique elegance of gold in terms of rich appearance, corrosion resistance, and sufficient durability. In relation to these desirable characteristics, it is believed that the price of a gold simulating alloy might be of secondary importance, so long as it remains only a fraction of the price of gold.

More specifically, the present invention relates to a copper-aluminum-indium alloy which approaches gold in spectral appearance, tarnish resistance and mechanical durability, by virtue of a specific formulation and microstructure. The required formulation of the present invention consists of the following essential ingredients by total weight, in a copper matrix: from 7 to 12% of aluminum, from 5 to 11% of indium, and no more than 3% of essentially non-ferromagnetic remainder. The required microstructure is in the form of an essentially ternary alloy having a quenched single phase, and an average grain size of no more than 1,000 micrometers (μm) in diameter. Preferably, the above specified 3% remainder includes: a modifier selected from the class consisting of boron, silicon, lithium, magnesium, zinc and phosphorous; a strengthener selected from the class consisting of silver, gold, palladium, platinum, iridium, ruthenium and rhodium; and a system stabilizer, preferably selected from the class consisting of yttrium, cerium, lanthanum, hafnium, zirconium, chromium, titanium, nickel, iron and manganese.

The alloy of the present invention has a specularity and a chromaticity very close to those of gold. These characteristics, however, are derived at the expense of usually desirable mechanical properties. This alloy is adapted for the production of elegant metal objects including jewelry, flatware, holloware, coinage, etc., having a rich gold-like appearance and excellent resistance to corrosion, although its mechanical properties are not as satisfactory as those of real high purity gold.

Other objects of the present invention will in part be obvious and will in part appear hereinafter.

BRIEF DESCRIPTION OF THE DRAWINGS

For a fuller understanding of the nature and objects of the present invention, reference is made to the following detailed description, which is to be taken in connection with the accompanying drawings wherein.

DETAILED DESCRIPTION OF THE PREFERRED EMBODIMENT

Formulation and Microstructure

The copper-aluminum-indium alloy of the present invention is unusual in that it does not require a high strength, high softening temperature, or maximum elevated temperature properties. What is wanted and is acceptable in the absence of these usually required properties is an asthetically pleasing metal that is golden in color, tarnish and corrosion resistant, and easily fabricated by standard techniques. Mechanical properties are traded off against the more desired properties. Because the alloy properties needed are focused on appearance primarily, the normal approach of ensuring phase transformations for strengthening is not necessary. Because the most important properties besides color are tarnish and corrosion resistance, the best microstructure is single phase. Such a single phase structure is easily fabricated both by hot and cold forming methods.

The copper-aluminum-indium alloy of the present invention approaches gold in spectral appearance and tarnish resistance, by virtue of a specific formulation and a specific microstructure, both of which now will be described.

The required formulation of the present invention consists of the following essential ingredients by total weight:

| Ingredient | Preferred Range % by Total Weight |
|---|---|
| Aluminum | 7 to 12 |
| Indium | 5 to 11 |
| Modifier | 0 to 3 |
| Strengthener | 0 to 3 |
| System Stabilizer | 0 to 3 |
| Copper | Remainder |

In this system, two white metals, aluminum and indium are added to copper, which is reddish in color. The combination, in approximately balanced proportions, imparts the intermediate color of rich gold. The addition of aluminum or indium alone to copper does not provide such a pleasant gold tone. Preferably: the oxide modifier is selected from the class consisting of boron, silicon, lithium, magnesium, zinc and phosphorous; the strengthener is selected from the class consisting of silver, gold, palladium, platinum, iridium, ruthenium and rhodium; and the system stabilizer is preferably selected from the class consisting of yttrium, cerium, lanthanum, hafnium, zirconium, chromium, titanium, nickel, iron and manganese. All of these ingredients are selected for their substantial neutrality or their ability to enhance color, corrosion resistance and mechanical properties.

Figure 1:
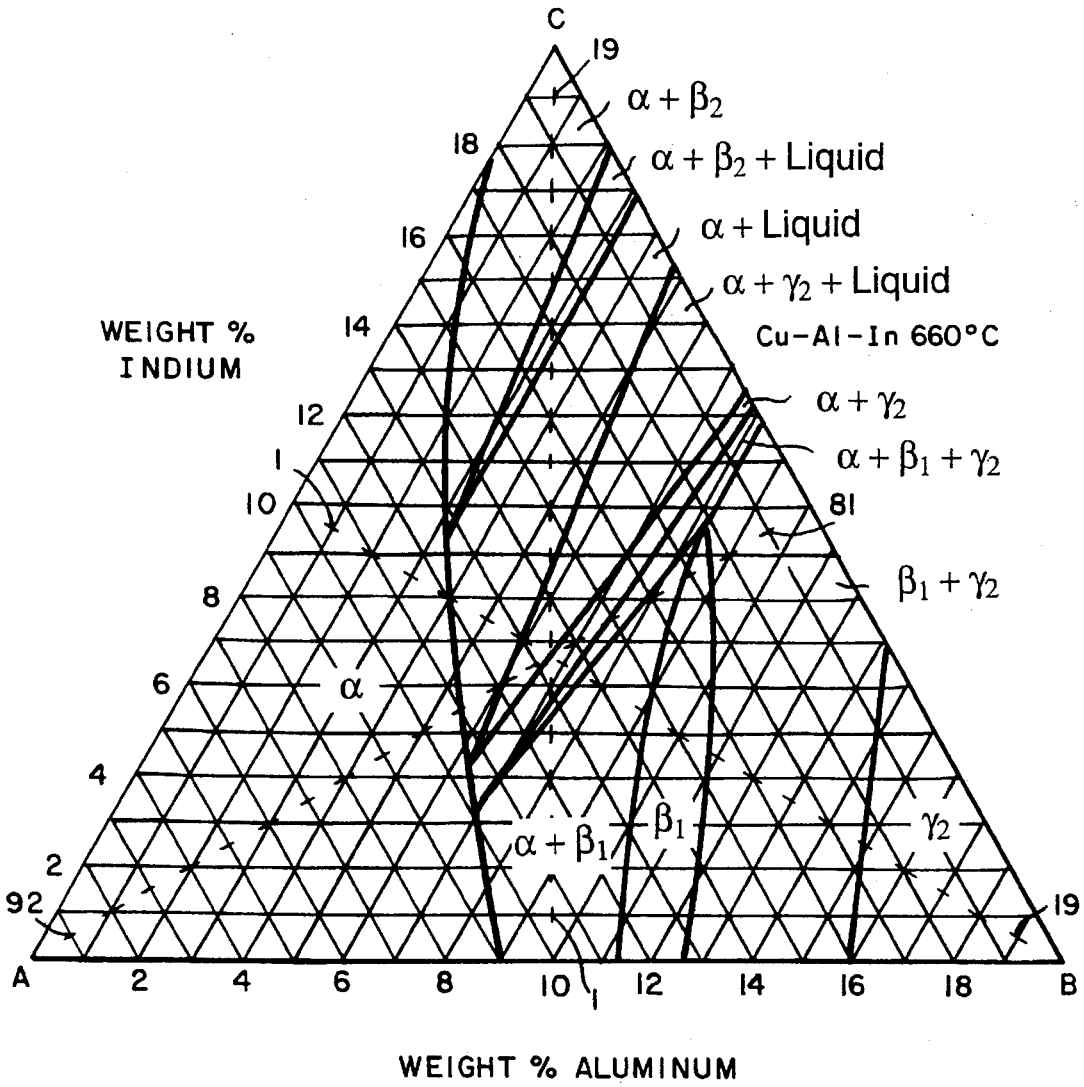
FIG. 1 is an isothermal ternary diagram of a copper-aluminum-indium melt at 660° C.
Figure 2:
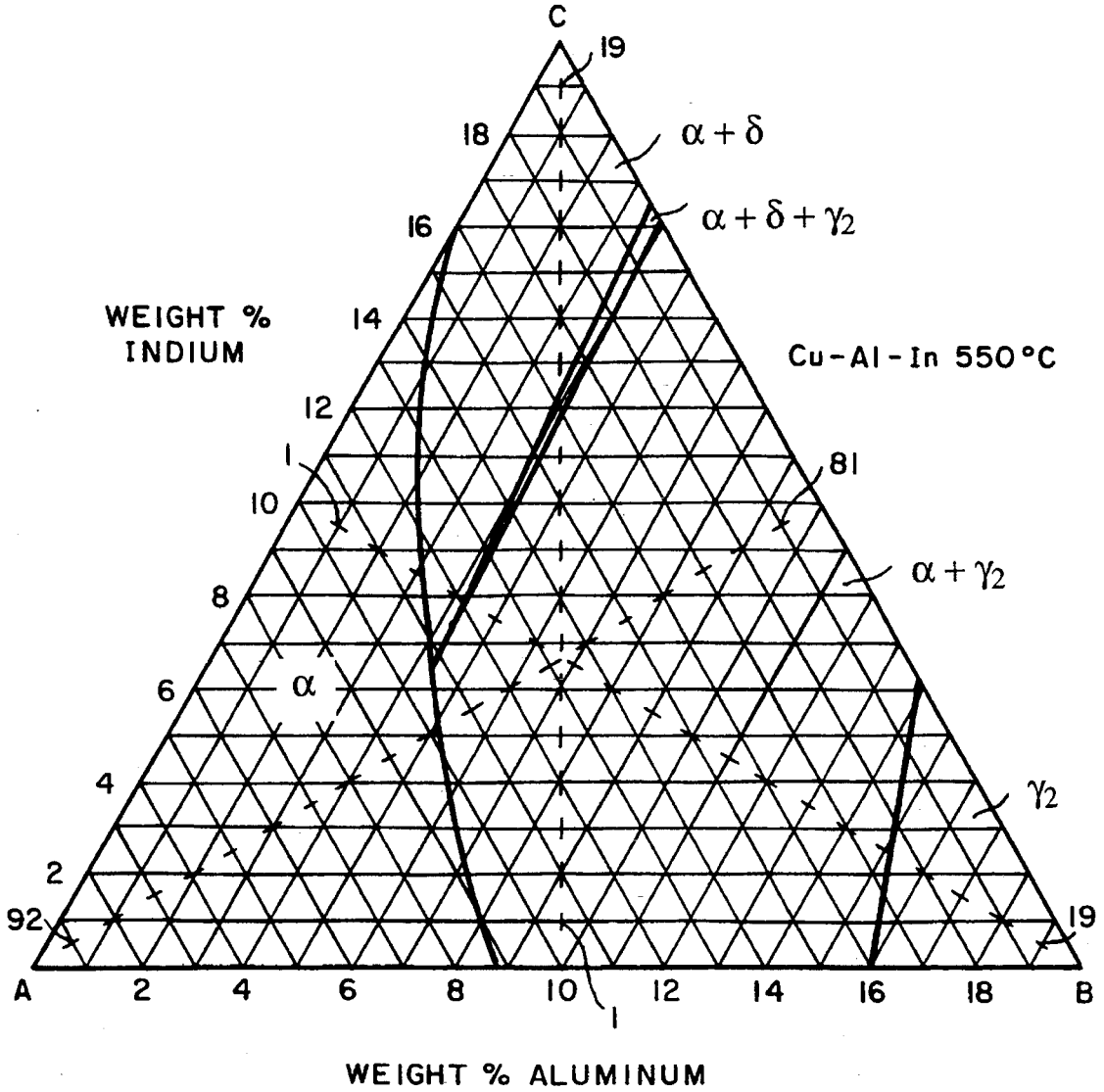
FIG. 2 is an isothermal ternary phase diagram of the copper-aluminum-indium melt of FIG. 1 at 550° C.

The required microstructure, in reference to FIGS. 1 and 2 is a quenched single phase having an average grain size of no more than 200 microns in diameter.

The modifiers are designed to perform the following functions: (a) to act as scavengers; (b) to act as grain refiners; (c) to improve ease of forming; and (d) to improve polishibility. The strengtheners are designed to perform the following functions: (a) to improve mechanical properties; (b) to provide grain-refining; (c) to retard grain-growth; and to improve corrosion and tarnish resistance further. The system stabilizers are designed to perform the following functions: (a) to control the nature of oxides for better corrosion and tarnish resistance; and (b) to retard grain-growth.

In multiphase alloys, the phases in the alloy have different electro-chemical potentials. Consequently, there is always a tendency for the most anodic phase to be corroded preferentially. The extent to which this occurs depends upon how great the potential difference is between the anodic phase and the surrounding phases and upon the distribution and intrinsic corrosion resistance of the anodic phase. In a single phase alloy, as in the present case, especially with a fine grain structure, no electro-chemical potential differential exists and thus it possesses higher resistance to selective phase attack.

Presence of the β phase in α-β brass (Cu-Zn) system, usually results in a reduction of corrosion. This is not true for the β phase in copper-aluminum and copper-indium systems. The β phase is a high temperature phase, which can transform into α (primary solid solution) and $\gamma_2$ phases. The latter is corrosion-prone and hence poses a selective phase corrosion problem especially if it forms a continuous network. The key then is to stabilize the β phase to room temperature and thereby to achieve a single phase alloy. The balanced combination of aluminum and indium in a copper base results in such a microstructure.

Experimental

The technical approach for deriving the information contained herein was as follows. A total of 5 heats having the same base composition but with various In contents were vacuum induction melted in 150 gram heats. One heat each of 0, 1.5 and 3% In and two heats of 5.5% In were produced. On theoretical grounds, it was thought that it was necessary to have a single phase alloy, and this criteria influenced alloy selection. The alloys had a Cu base composition that contained 7% Al with 0.025% B. The melts were produced in 150 gm charges using Cu-200 scrap, Cu-48% Al master alloy, Cu-2% B shot, and pure In sheet. To produce the In modified bronzes, a master alloy of 7% Al, 0.025% B was first produced. The master alloy was then remelted with various additions of In to give the final desired compositions. All melting was by vacuum induction in alumina crucibles. The melts were sectioned, examined metallographically, and composition checked by scanning electron microscopy in an energy dispersive system (SEM/EDS). Coupons approximately 0.125" thick were cut from each melt and polished for corrosion testing. Tarnish resistance was evaluated by hanging a coupon from a stainless steel wire above a boiling solution of a commercial detergent, sold under the trade designation CASCADE, in distilled water for a period of 20 minutes. In addition to as-cast material, several coupons were solution heat treated at 550°, 650° and 800° C. for times ranging from 1 to 22 hours and tested. Solution treatment involved packing the coupon in graphite chips to prevent oxidation, and heating in air followed by a water quench. Without the graphite chips, the coupon formed a blue surface oxide. Heat treating in a salt bath was also tried, but resulted in dissolution of the In rich phase and so was abandoned.

Results of the tarnish testing and SEM/EDS compositional measurements are given in the FIGS. 1 and 2. The microstructures of all the In containing alloys were composed of two phases: a matrix phase and a lamellar phase. The composition of each phase was relatively constant and independent of In content. The matrix phase contained approximately 7% Al and 2% In, while the lamellar phase contained typically 2–4% Al and 30–40% In. The lamellar phase was most likely related to the β phase in the Cu-In system which is similar in structure to β brass. The β phase contained about 27–37% In and was formed through a peritectic reaction. Alternatively, the high In phase could have been a variant of the γ phase in the Cu-In system. The γ phase has a nominal composition of 43% In. The β phase had a melting point of about 710° C., while the γ phase had a melting point of about 690° C.

Several heat treatments were used to modify the microstructure of the alloy and produce local changes in the composition of the phases. The effect of heat treatment was dependent of both time and temperature. At 550° C., essentially no change was observed in the phase compositions or microstructures, and there was no improvement in tarnish resistance.

After a treatment at 650° C. for 7 hours the In content in the matrix increased to over 5% and an improvement in tarnish resistance was noted. Heat treating at 800° C. produced the most dramatic change. After heating for four hours in air there was a fairly high degree of homogenization and decrease in the amount of the In rich phase. This sample also had the best overall tarnish resistance. However, longer times at 800° C. resulted in substantial loss of In though local melting of the In rich phase, and consequently very poor tarnish resistance. Since 800° C. is above the melting temperature of either the β or the γ Cu-In phase, melting of similar type In rich phases in the Cu-Al-In system occurred and was to be expected. It is evident that 800° C. is not a suitable solution treatment for temperature for these alloys. Based on these results, 650° C. was selected as the optimum solution treatment temperature.

All alloys containing less than 5.5% In tarnished rapidly. The 0, 1.5, and 3.0% In alloys were heavily discolored and covered by a very tenacious oxide film. Heat treatment did not significantly improve the tarnish resistance of any of the low In alloys as compared to the alloy containing 5.5% In. Although the 5.5% In alloy did not exhibit appreciable tarnish resistance in the as-cast condition, a slight improvement occurred after heating for 17 hours at 650° C. As noted above, solution heat treating at 800° C. for 4 hours resulted in the best overall tarnish resistance. In this case, the surface appearance consisted of both bright or non-tarnished areas that were tarnished and conclusions were drawn on that basis. A check of the compositional differences between these areas revealed that the bright areas had an In concentration on the order of 10% while the tarnished areas contained less than 5% In.

Two additional alloy coupons were made by adding 5% and 10% indium to a master alloy consisting of 92.975% copper, 7% aluminum and 0.025% boron. The coupons were metallurgically polished and placed in styrofoam coffee cups containing eggs, salt and water. The cups were placed in a gas oven with only the pilot light operational and stored for about a month. The resulting mixture represented a chloride and sulfurous environment. After one month, the coupons were removed from the cups, washed, rinsed thoroughly and dried. The above test demonstrated that the alloy, which contained about 10% indium, had no tarnished layer on its surface.

From the foregoing study and from theoretical considerations, the above defined parameters of the present invention were determined.

EXAMPLES

The following range of examples of the alloy of the present invention are based on theoretical considerations and on the above experimentation.

Example 1

A melt of the following elements is heated to approximately 600° C. and quenched to produce a substantially single phase alloy having a microstructure with an average grain size of no more than 1,000 μm in diameter, a chromaticity and specularity closely similar to that of gold and the following formulation:

| Ingredient | % by Total Weight |
|---|---|
| Aluminum | 9% |
| Indium | 9% |
| Boron | 0.2% |
| Gold | 1% |
| Copper | Remainder |

Example 2

A melt of the following elements is heated to approximately 600° C. and quenched to produce a substantially single phase alloy having a microstructure with an average grain size of no more than 1,000 μm in diameter, a chromaticity and specularity closely similar to that of gold and the following formulation:

| Ingredient | % by Total Weight |
|---|---|
| Aluminum | 7% |
| Indium | 9% |
| Boron | 0.2% |
| Silver | 2% |
| Copper | Remainder |

Example 3

A melt of the following elements is heated to approximately 600° C. and quenched to produce a substantially single phase alloy having a microstructure with an average grain size of no more than 1,000 μm in diameter, a chromaticity and specularity closely similar to that of gold and the following formulation:

| Ingredient | % by Total Weight |
|---|---|
| Aluminum | 11% |
| Indium | 9% |
| Silicon | 0.2% |
| Palladium | 1% |
| Copper | Remainder |

Example 4

A melt of the following elements is heated to approximately 600° C. and quenched to produce a substantially single phase alloy having a microstructure with an average grain size of no more than 1,000 μm in diameter, a chromaticity and specularity closely similar to that of gold and the following formulation:

| Ingredient | % by Total Weight |
|---|---|
| Aluminum | 10% |
| Indium | 11% |
| Silicon | 0.2% |
| Yttrium | 0.2% |
| Ruthenium | 1% |
| Gold | 1% |
| Copper | Remainder |

Example 5

A melt of the following elements is heated to approximately 600° C. and quenched to produce a substantially single phase alloy having a microstructure with an average grain size of no more than 1,000 μm in diameter, a chromaticity and specularity closely similar to that of gold and the following formulation:

| Ingredient | % by Total Weight |
|---|---|
| Aluminum | 8% |
| Indium | 8% |
| Boron | 0.02% |

-continued

| Ingredient | % by Total Weight |
|---|---|
| Yttrium | 0.2% |
| Gold | 1% |
| Iridium | 1% |
| Copper | Remainder |

Example 6

A melt of the following elements is heated to approximately 600° C. and quenched to produce a substantially single phase alloy having a microstructure with an average grain size of no more than 1,000 μm in diameter, a chromaticity and specularity closely similar to that of gold a and the following formulation:

| Ingredient | % by Total Weight |
|---|---|
| Aluminum | 9% |
| Indium | 9% |
| Boron | 0.02% |
| Yttrium | 0.2% |
| Gold | 1% |
| Platinum | 1% |
| Copper | Remainder |

OPERATION

The illustrated copper-aluminum-indium alloy approaches gold in spectral appearance, tarnish resistance and mechanical durability, by virtue of a specific formulation and microstructure. The required formulation consists of the following essential ingredients by total weight, in a copper matrix: from 7 to 12% of aluminum, from 5 to 11% of indium, and no more than 3% of essentially non-ferromagnetic remainder. The required microstructure is in the form of an essentially ternary alloy having a quenched single phase, and an average grain size of no more than 1000 μm in diameter. Preferably, the above specified 3% remainder includes: a modifier selected from the class consisting of boron, silicon, lithium, magnesium, zinc and phosphorous; a strengthener selected from the class consisting of silver, gold, palladium, platinum, iridium, ruthenium and rhodium; and a system stabilizer, preferably selected from the class consisting of yttrium, cerium, lanthanum, hafnium, zirconium, chromium, titanium, nickel, iron and manganese.

What is claimed:

1. An alloy consisting of the following elements as essential ingredients, said alloy having substantially a single β phase and a microstructure with an average grain size of no more than 1,000 μm in diameter, a chromaticity and specularity closely similar to that of gold, a malleability less than that of gold:

| Ingredient | % by Total Weight |
|---|---|
| Aluminum | 7–12 |
| Indium | 5–11 |
| Strengtheners | 0–3 |
| Stabilizer | 0–3 |
| Modifier | 0–3 |
| Copper | Remainder |

the total percentage of said strengtheners, said stabilizer, and said modifier being from 0.025 to 3, said strengtheners being selected from the class consisting of silver, gold, palladium, platinum, iridium, ruthenium and rhodium, said stabilizer being selected from the class consisting of yttrium, cerium, lanthanum, hafnium, zirconium, chromium, titanium, nickel, iron and manganese, and said modifier being selected from the class consisting of boron, silicon, lithium, magnesium, zinc and phosphorus.

2. An alloy consisting of the following elements as essential ingredients, said alloy having substantially a single β phase and a microstructure with an average grain size of no more than 1,000 μm in diameter, and a chromaticity and specularity closely similar to that of gold, a malleability less than that of gold, said ingredients including, by total weight, aluminum—7–12%, indium—5–11%, gold—0.1–3%, and copper—remainder.

3. An alloy consisting of aluminum, indium, strengtheners, a stabilizer, a modifier, and copper as essential ingredients:

(a) said alloy having substantially a single β phase, a microstructure with an average grain size of no more than 1,000 μm in diameter, a chromaticity and specularity closely similar to that of gold, and a malleability less than that of gold;

(b) said aluminum comprising 7–12% by total weight;

(c) said indium comprising 5–11% by total weight;

(d) the sum of said strengtheners, said stabilizer, and said modifier comprising not more than 3% by total weight;

(e) said copper comprising the remainder;

(f) said strengtheners being selected from the class consisting of silver, gold, palladiuum, platinum, iridium, ruthenium, and rhodium;

(g) said stabilizer being selected from the class consisting of yttrium, cerium, lanthanum, hafnium, zirconium, chromium, titanium, nickel, iron, and manganese; and (h) said modifier being selected from the class consisting of boron, silicon, lithium, magnesium, zinc, and phosphorus.

4. An alloy consisting of aluminum, indium, strengtheners, a stabilizer, a modifier, and copper as essential ingredients:

(a) said alloy having substantially a single β phase, a microstructure with an average grain size of no more than 1,000 μm in diameter, a chromaticity and specularity closely similar to that of gold, and a malleability less than that of gold;

(b) said aluminum comprising 7–12% by total weight;

(c) said indium comprising 5–11% by total weight;

(d) said strengtheners comprising 0.5–2.5% by total weight;

(e) said stabilizer comprising 0–0.2% by total weight;

(f) said modifier comprising 0.02–0.2% by total weight;

(g) said copper comprising the remainder;

(h) said strengtheners being selected from the class consisting of silver, gold, palladiuum, platinum, iridium, ruthenium, and rhodium;

(i) said stabilizer being selected from the class consisting of yttrium, cerium, lanthanum, hafnium, zirconium, chromium, titanium, nickel, iron, and manganese; and (j) said modifier being selected from the class consisting of boron, silicon, lithium, magnesium, zinc, and phosphorus.

* * * * *